US012029365B2

(12) United States Patent
Milanese

(10) Patent No.: US 12,029,365 B2
(45) Date of Patent: Jul. 9, 2024

(54) HOT CLEANING APPARATUS FOR SURFACES PROVIDED AT LEAST WITH A MOISTURE SENSOR OF THE CLEANING CLOTH

(71) Applicant: Pier Antonio Milanese, Susegana (IT)

(72) Inventor: Pier Antonio Milanese, Susegana (IT)

( * ) Notice: Subject to any disclaimer, the term of this patent is extended or adjusted under 35 U.S.C. 154(b) by 912 days.

(21) Appl. No.: 17/042,426

(22) PCT Filed: Mar. 22, 2019

(86) PCT No.: PCT/IT2019/050062

§ 371 (c)(1),
(2) Date: Sep. 28, 2020

(87) PCT Pub. No.: WO2019/186608

PCT Pub. Date: Oct. 3, 2019

(65) Prior Publication Data

US 2021/0076896 A1 Mar. 18, 2021

(30) Foreign Application Priority Data

Mar. 30, 2018 (IT) ..... 102018000004142

(51) Int. Cl.
*A47L 13/22* (2006.01)
*A47L 13/256* (2006.01)

(52) U.S. Cl.
CPC ..... *A47L 13/225* (2013.01); *A47L 13/256* (2013.01)

(58) Field of Classification Search
CPC ..... A47L 13/22; A47L 13/225; A47L 13/256; A47L 13/257
See application file for complete search history.

(56) References Cited

U.S. PATENT DOCUMENTS

2014/0165324 A1 6/2014 Luo et al.
2014/0259510 A1* 9/2014 Conrad ..... A47L 11/4008 15/322
2014/0259516 A1 9/2014 Scolari

FOREIGN PATENT DOCUMENTS

WO 2016/055855 A2 4/2016
WO 2017/158631 A1 9/2017

OTHER PUBLICATIONS

International Search Report and Written Opinion issued on Jul. 4, 2019 in corresponding International Application No. PCT/IT2019/050062, 10 pages.

* cited by examiner

*Primary Examiner* — David G Cormier
(74) *Attorney, Agent, or Firm* — Maier & Maier, PLLC

(57) ABSTRACT

Hot cleaning device for surfaces suitable to keep the cleaning cloth automatically well soaked and in particular provided with one or more sensors for moisture detection, which detect the quantity of water/moisture on the cleaning cloth, in order to automatically convey a suitable water quantity onto the cleaning cloth for ideal cleaning.

14 Claims, 6 Drawing Sheets

FIG.8
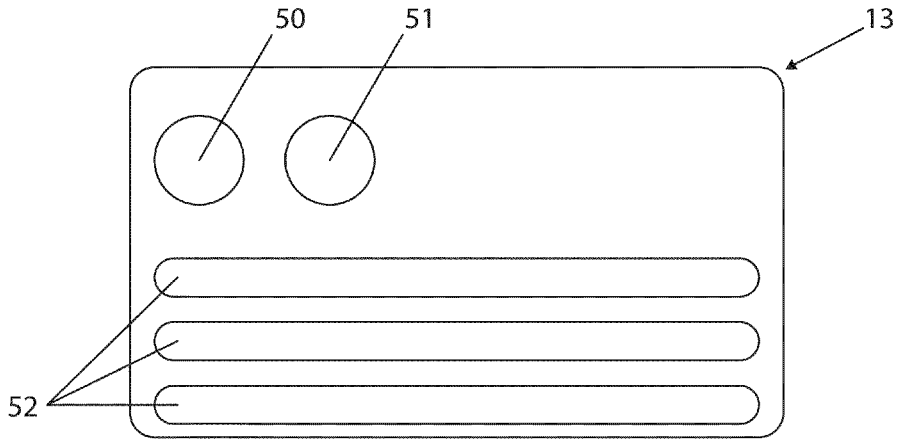
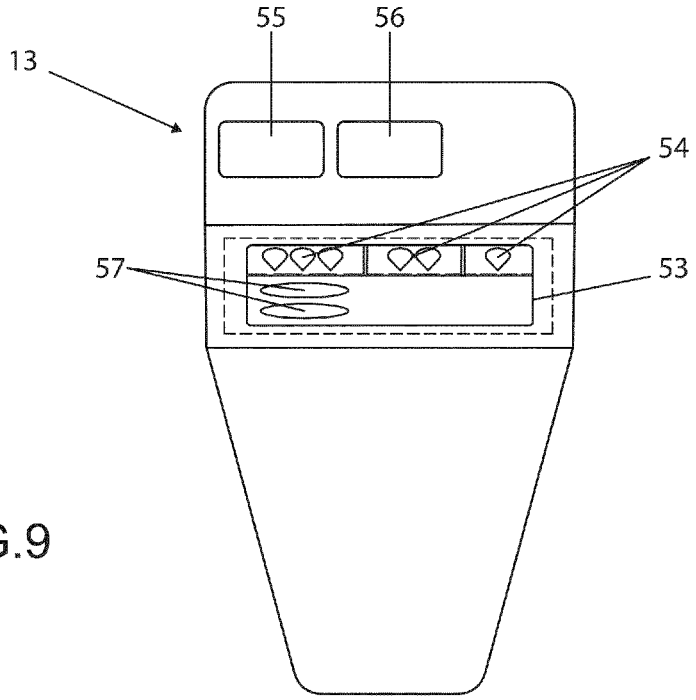
FIG.9

HOT CLEANING APPARATUS FOR SURFACES PROVIDED AT LEAST WITH A MOISTURE SENSOR OF THE CLEANING CLOTH

FIELD

This invention concerns a hot cleaning device for surfaces equipped with at least one moisture sensor of the cleaning cloth able to guarantee the suitable automatic soaking of the same cleaning cloth.

BACKGROUND

Several hot cleaning devices for surfaces are known that basically include the cleaning cloth under the brush that is in contact with the floor and a steam generator made of an instantaneous steamer or a boiler under pressure, where the steam produced by the steam generator is usually conveyed out to the cleaning cloth by tubes.

Moreover, devices are known for the hot cleaning of surfaces lying on a separated steam generator so that the steam goes against the device before performing the cleaning.

The most common problem of such devices is that the steam that has soaked the cleaning cloth gets immediately cold when the cloth is put in contact with the floor to clean, thus losing the temperature that would be indispensable for efficient cleaning.

Moreover, when continuing to soak the cloth with steam the cloth gets more and more dampened with water deriving from cold steam that is dragged on the floor, thus basically not cleaning it. Finally, there is a kind of device for surface cleaning equipped with a heated plate in direct contact with the cleaning cloth, so that the cloth can be heated and also provided with an upper water tank connected underneath with said cleaning cloth, so that the cloth can be cyclically dampened. Unfortunately, since the cleaning cloth is dampened cyclically with a set frequency it is not possible to establish the moisture level in said cleaning cloth when used and therefore it can be either too dry or too wet, thus not guaranteeing the proper cleaning of the floor.

SUMMARY

This invention aims at creating a surface hot cleaning device provided with at least one moisture sensor of the cleaning cloth that solves the problems described above.

BRIEF DESCRIPTION OF THE FIGURES

The cleaning device in compliance with the invention shows the characteristics described below—only as an example and with no limitations—and with reference to the figures enclosed where:

FIG. 8 shows a front view of a first construction of a further component of the device in FIGS. 1*a*-1*b;*

FIG. 9 shows a front view of a second construction of a further component of the device in FIGS. 1*a*-1*b;*

DETAILED DESCRIPTION OF THE EMBODIMENTS

In the description and in the figures below a surface hot cleaning device is described that is equipped with at least one moisture sensor for the cleaning cloth aiming at guaranteeing the suitable automatic dampening of the same cleaning cloth as it will be described below.

Figure 1A:
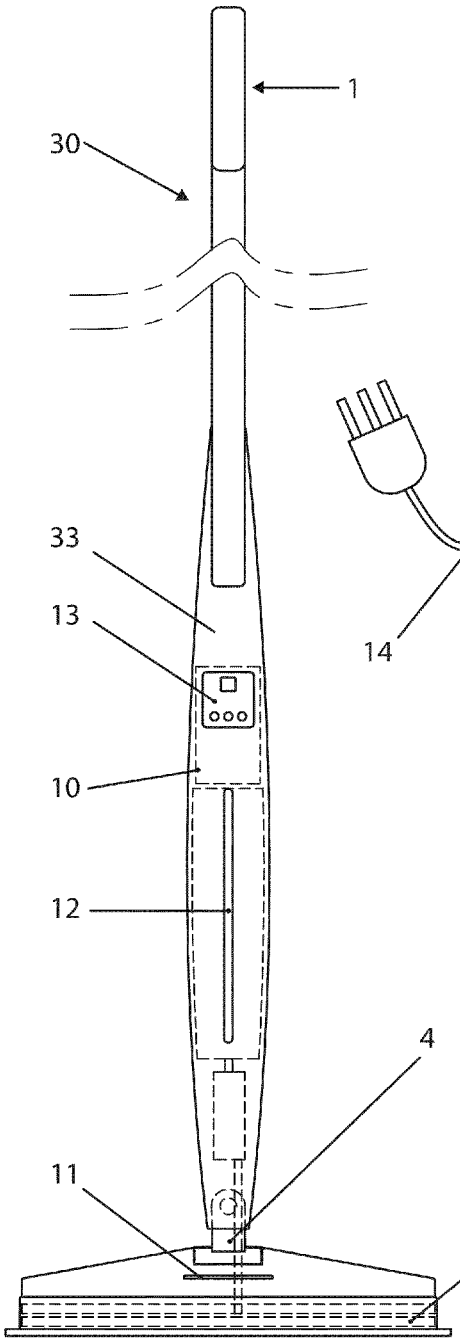
FIG. 1*a* shows a front view of the surface hot cleaning device in compliance with the invention.
Figure 1B:
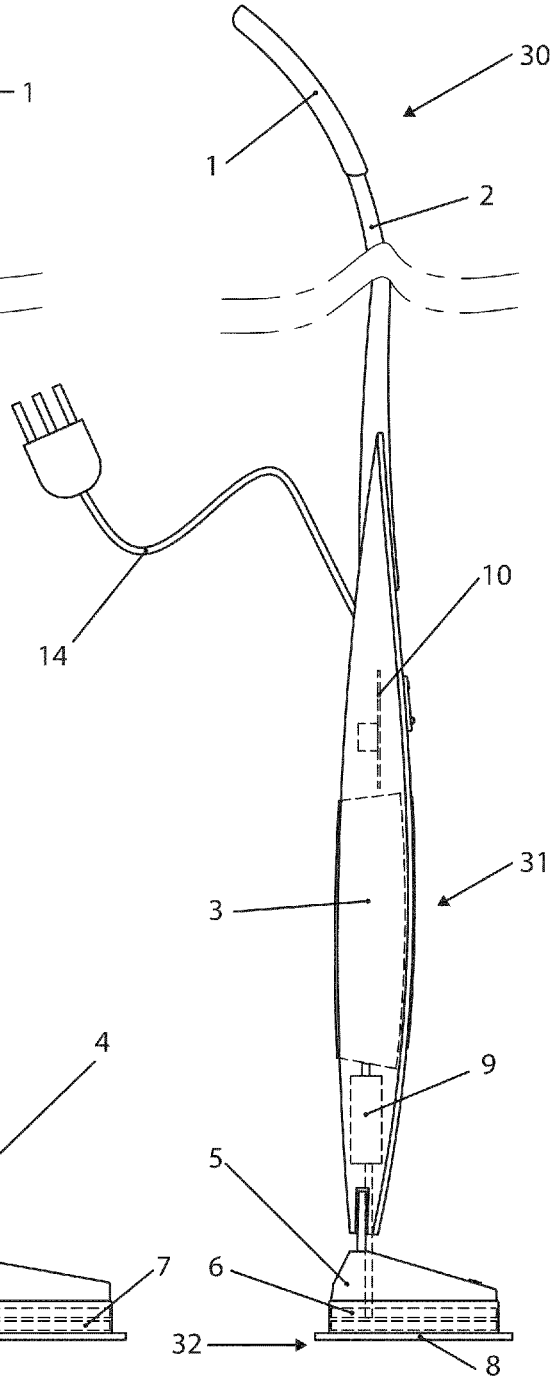
FIG. 1*b* shows a side view of the surface hot cleaning device in compliance with the invention.

FIGS. 1*a* and 1*b* show the cleaning device (30), being the object of this invention, where it can be seen that such cleaning device (30) is basically made of a first upper part (31) and a second lower part (32) that are linked by means of a mobile junction (4), such as for example a universal joint or the like, in which the first upper part (31) includes a supporting body (33) to which an upper handle is connected (2) with a grip (1) and a power supply cable (14) and that contains a PC board (10), a water tank (3), an electric pump (9), and in which the surface of such supporting body (33) is provided with a spy glass to see the water level (12) as well as the control and command devices for the cleaning modes (13), while said second lower part (32) includes a main supporting body (5) having the shape of a cover and preferably made of plastic to which are linked underneath in this sequence towards the bottom at least one heating means (6), at least one absorbing multilayer element (7) and at least one cleaning cloth (8), such supporting body (5) being possibly equipped on its upper part with a warning light or an acoustic device (11) to communicate that the device (30) is ready for use.

Figures 2, 2A:
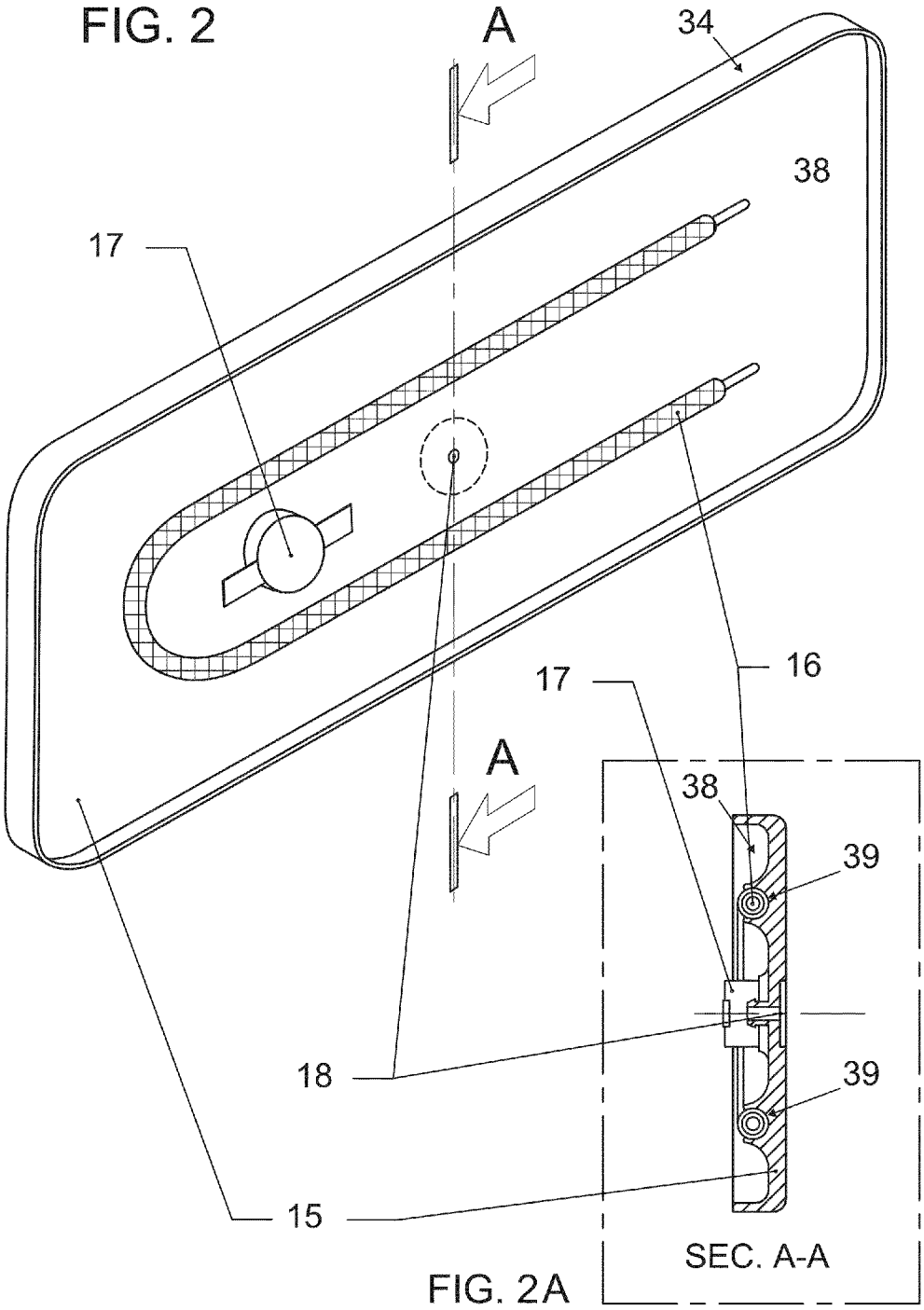
FIG. 2 shows a prospect view of a first element of the device in FIG. 1.
FIG. 2*a* shows a section view of the element in FIG. 2.

FIG. 2 shows the heating means (6), preferably made of a heating plate that consists of a flat stretched quadrangular supporting body (15) made of metal such as for example aluminium, provided with a perimetric edge (34) looking above and on whose lower surface (38) at least one heating element (16) and a means to measure the temperature (17) are fixed made for example of a thermistore with NTC probe, moreover such supporting body (15) is provided with a vertical central through hole to let water go through (18).

As it can be seen in FIG. 2*a*, such heating element (16) has a stretched shape preferably with round section and can be hosted by a long groove (39), with the preferred shape and carved into said lower surface (38) of the quadrangular supporting body (15) of the heating means (6).

Figure 3:
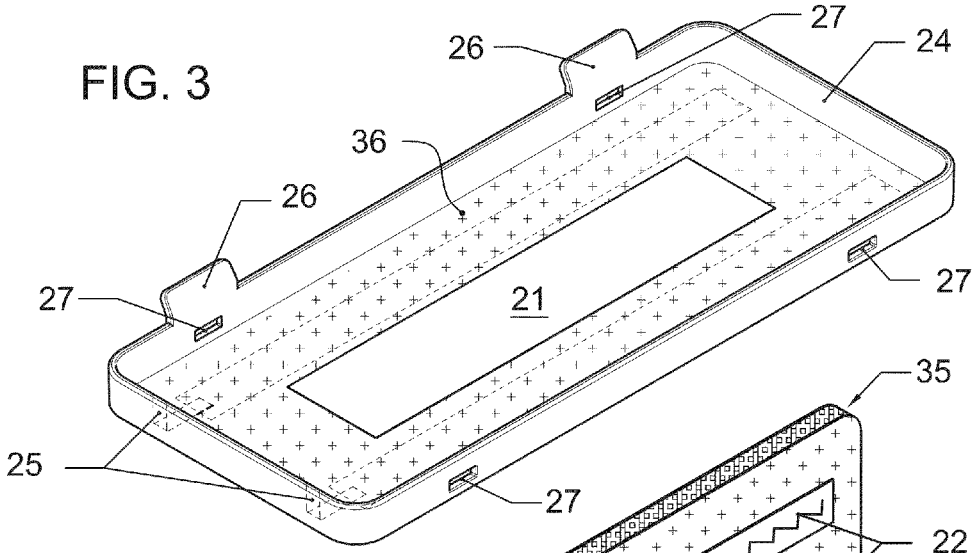
FIG. 3 shows a prospect view of a first construction of a second element of the device in FIG. 1.
Figure 4A:
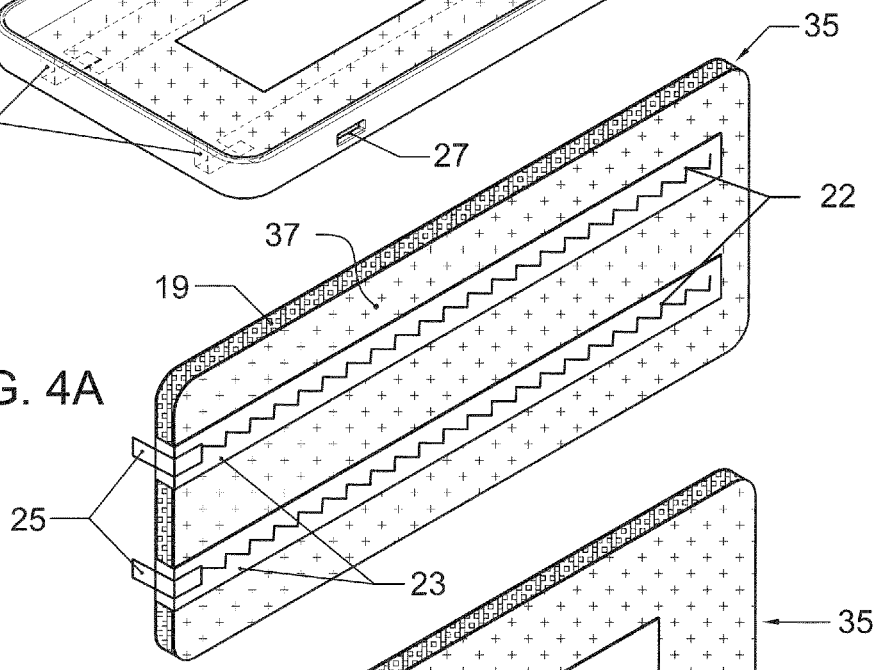
FIG. 4*a* shows a prospect view from beneath of a component of the element of FIG. 3.
Figure 4B:
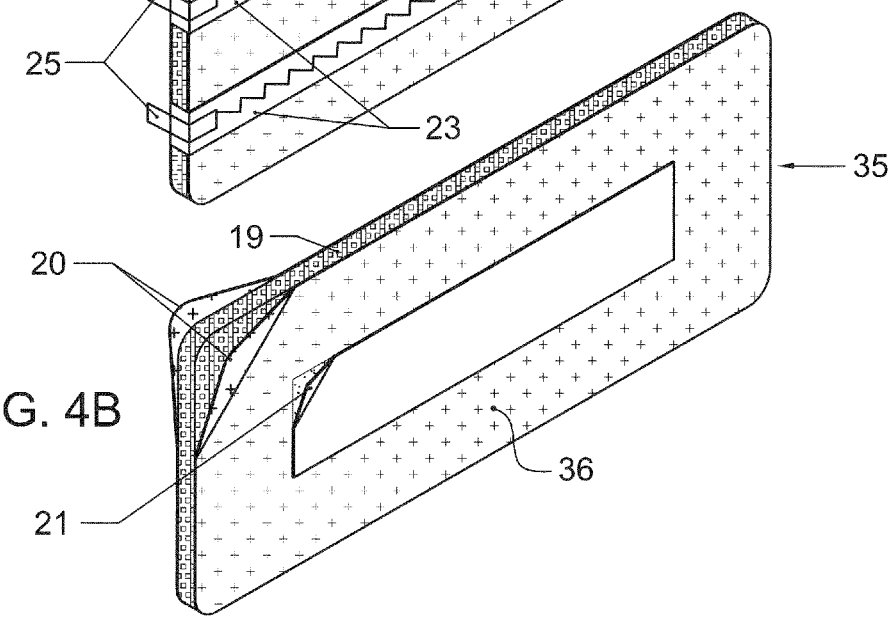
FIG. 4*b* shows a prospect view from above of the component of FIG. 4*a;*

FIG. 3 shows a view of the component of the absorbing multilayer element (7) in one of the first constructions, where the multilayer element (7) is made of a hollow quadrangular edge frame (24), provided with fast coupling and uncoupling devices on the edge (26, 27), where a quadrangular body is inserted (35) that can be seen also in FIGS. 4*a*-4*b*, which is made of at least one central panel (19)

in open-cell polyurethane foam with suitable thickness on which a polyester layer (20) is coupled on its upper surface (36) and on its lower surface (37) resistant to temperatures up to 140° C., such as for example a non-woven fabric or the like; moreover, on the upper non-woven fabric layer (20) in the middle part of the panel (19) a water-tight element (21) is installed (see FIG. 4*b*), while on the lower non-woven fabric layer (20) one or more sensors for moisture detection (22) are installed made of a conductive material of a known type with an interposed insulating base (23) (see FIG. 4*a*).

Such sensors for moisture detection (22) preferably have a thin and stretched shape and include contacts (25) that are connected to other electric contacts (29), preferably of pin type and the sensors are spread almost along the entire panel length (19).

Figure 5:
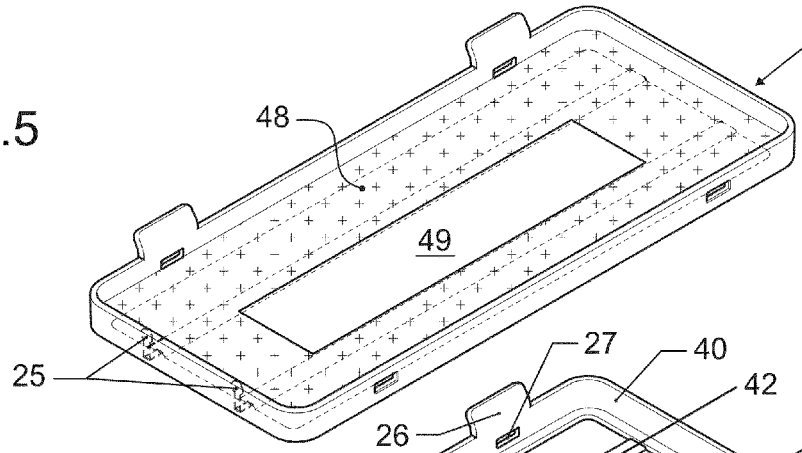
FIG. 5 shows a prospect view of a second construction of the second element of the device in FIG. 1.
Figure 6A:
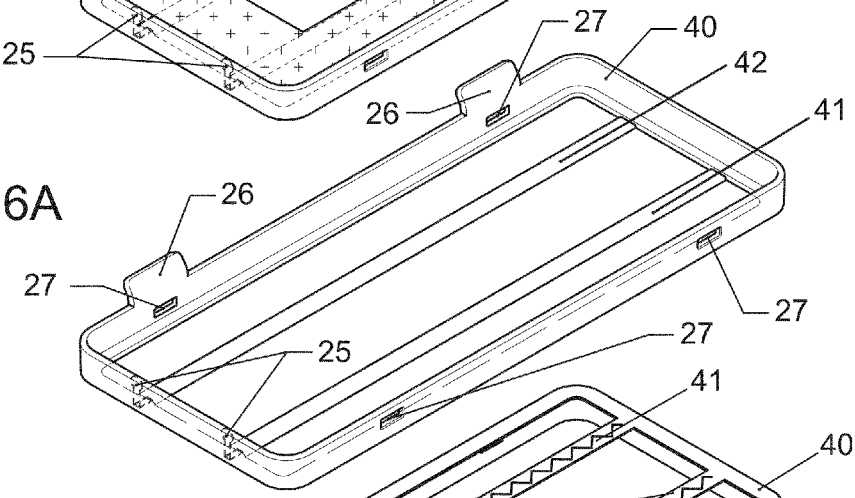
FIG. 6*a* shows a prospect view from above of a first component of the element in FIG. 5.
Figure 6B:
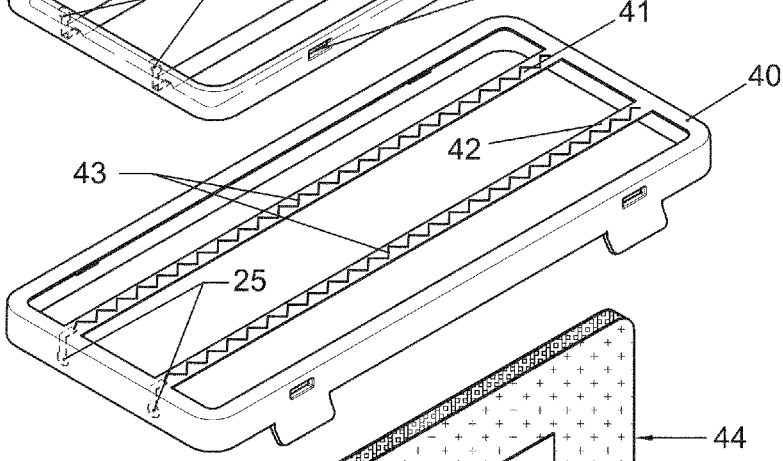
FIG. 6*b* shows a prospect view from below of the first component of FIG. 6*a;*

FIG. 5 shows a view of the components of the absorbing multilayer element (7) in its second construction, in which the multilayer element (7) is made of a hollow quadrangular frame along the edge (40), provided with fast coupling/uncoupling elements on the edge (26, 27) and in the middle and underneath with at least two insulating straps (41, 42) that are located far from each other either across the frame or along it (40), that can be seen in FIG. 6*a*-6*b*. Each insulating strap (41, 42) is provided underneath with one or more sensors for moisture detection (43) made of a conductive material already known.

Such sensors for moisture detection (43) preferably have a thin and stretched shape and include some contacts (25) that are connected with other electric contacts (29), preferably of pin type and such sensors are spread almost along the entire length of the insulating straps (41, 42).

Figure 7:
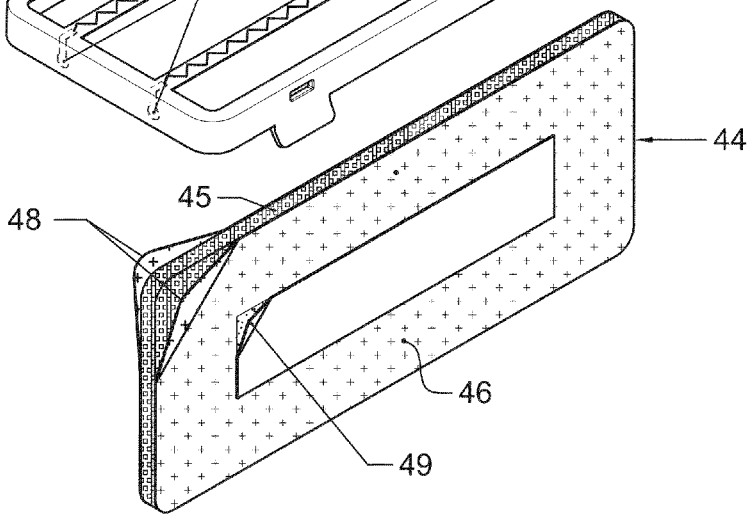
FIG. 7 shows a prospect view of a second component of the element in FIG. 5.

The edge frame (40), which is located above such insulating straps (41, 42), hosts a quadrangular body (44), which can be seen in detail in FIG. 7, in which such quadrangular body (44) is made of at least one central panel (45) in open-cell polyurethane foam with suitable density and thickness, on whose upper (46) and lower (47) surfaces a layer of polyester material is coupled (48) that is resistant to temperatures up to 140° C., such as for example a non woven fabric or the like; moreover the upper non woven fabric (48) is combined in the middle part of the panel (45) with a watertight element (49). This multilayer element (7) is joined to the lower part of the heating plate (15) and fastened by means of fast coupling/uncoupling devices (26 and 27), while on the lower part of said multilayer element at least one cleaning cloth (8) is fastened with known methods and in contact with said sensors (22, 43).

FIG. 8 shows a plan of such control and command means of the cleaning modes (13) in a first construction and it can be seen that they consist of at least one on/off element (50), such as for example a button or a switch, by at least one selector (51), such as for example a pushbutton or a touch button and at least one lamp (52) of any shape, like for example a LED light, so that with such selector (51) a preset moisture level is established, shown by a colour or a specific lamp blinking or a fixed LED light (52) or by a specific LED light (52) among various LED lights and afterwards the same system of LED lights or an acoustic device will communicate that the temperature detected by the thermistore (17) that is necessary to reach the preset level of moisture has been reached or that the water in the tank has finished (3).

FIG. 9 shows a plan of the control and command devices of the cleaning modes (13) in their second construction and it can been seen that they consist of at least one display (53) showing at least the preset moisture level (54), at least the temperature detected by the thermistore (17) either in ° C. or ° F. and are formed by one or more on/off devices (55) and a selector for the preset moisture (56), such as for example push or touch buttons or are part of the display (53) if of touch-screen type.

This display (53) can also be provided with one or more lamps (57) of any shape, such as for example LED lights possibly combined with an acoustic device to show when blinking or showing a fixed light or a special colour that the water in the tank has finished (3) and/or the temperature detected by the thermistore (17) that has been set to produce the selected preset moisture.

Figure 10:
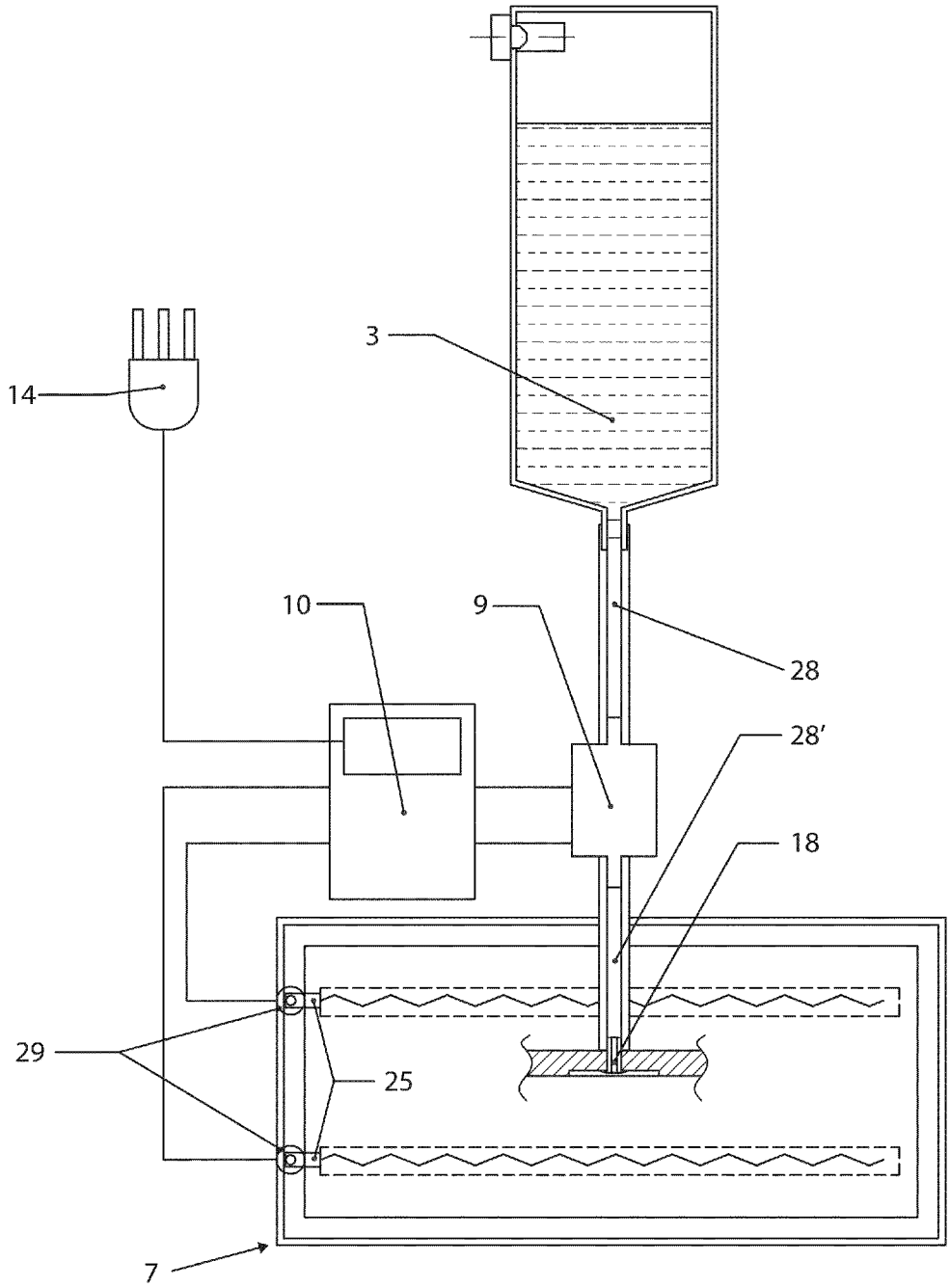
FIG. 10 shows a plan of the cleaning device in FIG. 1, compliant with the invention.

FIG. 10 shows a plan of the cleaning device (30), and in particular the dampening and moisture detection circuit of the cleaning cloth (8) and it can be seen that the water tank (3) is connected through a first flexible or rigid pipe (28) to the electric pump (9), which is connected to a second rigid or flexible pipe (28') to the central hole (18) of the heating plate (15), so that the water coming out of the tank (3) and pumped out by the electric pump (9) and therefore going downwards can reach and get through the multilayer element (7) to moisten directly the cleaning cloth (8). The heating element (16), connected to and automatically controlled by the PC board (10), is suitable to heat the supporting body (15), which is in direct contact with the multilayer element (7), so that the water flowing into this element can be heated by said heating body (15) by thermal conduction.

The thermistore (17), which is also connected to and controlled by the PC board (10), when detecting the temperature of the water flowing into the multilayer element (7) and according to the preset temperature level starts or does not start said heating element (16), thus keeping the water at a selected temperature.

The central panel (19, 45) has a suitable size to absorb and retain a certain quantity of water, thus acting as a further water tank and the water then gradually flows to the cleaning cloth (8) located under it, moreover the watertight upper central element (21, 49) is shaped so that it guides the water onto the edge of the panel (19, 45), so that the surface of the panel can absorb it on its entire surface and not only in its central part.

It can also be remarked that the PC board (10), powered by the power supply cable (14), is connected to the electric pump (9) and to the moisture detection sensors (22, 43) through the contacts (29) and the contacts (25), like the sensors (22, 43) are in contact with the upper surface of the cleaning cloth (8).

In this configuration the sensors (22, 43) can detect the moisture level only of the cleaning cloth (8), because they are insulated from the upper panel with insulating material (23; 41 and 42), and the PC board (10) can then control the electric pump (9) so that the latter can automatically feed or not feed the multilayer element (7) with water that is heated by the heating element (6), according to the values set by means of the control and command devices of the cleaning modes (13).

In particular, the moisture on the cleaning cloth (8) is detected by reading the electrical conductivity of the water on the cleaning cloth, in the way described below.

The PC board (10) reads the value of the electrical resistance (R) between the two sensors made of conductive material (22, 43) and it compares it with a reference value (X) already preset by using the control and command devices of the cleaning modes (13), and in case the cleaning cloth (8) is too dry the electrical resistance value will be very high (R>X), and in this case the PC board (10) starts the electric pump (9) that takes the water from the tank (3) and conveys it to the cleaning cloth (8), thus soaking it and increasing its electrical conductivity and reducing its electrical resistance (R).

The electric pump (9) continues to work until the electrical resistance measured between the sensors (22, 43) equals or is lower than the reference value of the PC board (10) (R=X), and in this condition it turns off automatically.

When the electric pump has turned off (9), the cloth (8) is soaked with the quantity of water/moisture that is ideal for the cleaning operations one wishes to perform.

When using the cleaning device (30), the quantity of water absorbed by the cloth (8) slowly diminishes, while, as a consequence, the electrical resistance between the sensors (22, 43) increases, thus getting back to the situation R>5 X and restarting the electric pump cycle (9), as described above. Therefore, according to the X reference value stored in the PC board (10), the cleaning device (30) can provide the desired moisture level to the cleaning cloth (8), such as for example a low moisture level to clean wooden or particularly sensitive surfaces, an average moisture level to clean smooth and glossy surfaces or a high moisture level to clean traditional, rough surfaces and the like.

The cleaning device (30) can also be provided with a motion sensor (not shown) connected to the PC board (10) that feels when the cleaning device (30) is on and is moving, i.e. is being used, and the same PC board (10) turns off the acoustic device that showed that the set temperature had been reached.

The cleaning device (30) can also be used in dry mode with a duster and without electric connections. The functioning of this device can be then summed up as follows:

the device in this construction allows cleaning surfaces with the ideal dampening of the cleaning cloth (8) that is kept at the same temperature as the heating plate (6), thus guaranteeing the perfect cleaning and sanitation of the floors.

The invention claimed is:

1. A hot cleaning apparatus for surfaces, adapted to ensure an adequate wetting of a cleaning cloth in an automatic manner, comprising:

an upper part and a lower part joined to each other in a hinged way by a movable connection, the upper part comprising a support body to which an upper handle with grip and a power supply cable are joined, the support body enclosing an electronic circuit board connected to and supplied by the cable, and a tank for water joined with a first flexible or stiff pipe to an electric pump, the support body being provided on a surface thereof with a control and command means for a cleaning modality, the lower part comprising a main support body made of plastic and containing at least a heating means, and at least a cleaning cloth, the main support body being joined at an upper part thereof to said electric pump by a second stiff or flexible pipe in such a way that the water is able to be taken from the tank by the electric pump so as to then be conveyed toward the cleaning cloth, and at least an absorbing multilayer element inserted and secured in contact between said heating means and said cleaning cloth, wherein said absorbing multilayer element includes a quadrangular peripheral hollowed frame, into which a quadrangular body is inserted, the quadrangular body including at least a central panel made of absorbing material, to which there are respectively coupled to upper and lower surfaces thereof an upper non-woven layer and a lower non-woven layer, the non-woven layers being made of polyester material that is resistant to temperatures up to 140° C., and sensors for detecting moisture, made of conductive material and installed below said multilayer element in an insulated way therefrom, the sensors being arranged in contact with the cleaning cloth, wherein the central panel is adapted to receive, to absorb and to keep a certain quantity of the water that is supplied by the electric pump through the second pipe, the central panel acting as an additional water container, thereby allowing the water to flow gradually toward the cleaning cloth disposed under the central panel, wherein said sensors are adapted to detect an electrical conductivity value of the water in the cleaning cloth only, and the electronic circuit board is adapted to read a value of an electrical resistance R between the sensors and to compare the electrical resistance R to a reference value X pre-set at the control and command means for the cleaning modality, wherein, if the cleaning cloth is dry, and, consequently, the electrical resistance R is high, the electronic circuit board causes the electric pump to take the water from the tank and supply the water to the central panel, which absorbs the water and releases the water to the cleaning cloth, thereby soaking the cleaning cloth, increasing the electrical conductivity, and decreasing the electrical resistance R, wherein said electric pump remains active until a value of the electrical resistance R detected between the sensors is equal to or lower than the reference value X, said electric pump being adapted to turn itself off automatically when in the cleaning cloth there is present a desired quantity of the water for a desired cleaning operation, and wherein, during the use of the cleaning apparatus, as the quantity of water within the cleaning cloth decreases, and, consequently, the electrical resistance R increases, the electric pump is reactivated if the value of the electrical resistance R is greater than the reference value X.

2. The cleaning apparatus according to claim 1, wherein, according to the reference value X, the cleaning apparatus confers the desired quantity of the water to the cleaning cloth, the reference value X being set at the control and command means for the cleaning modality and corresponding to the desired cleaning operation.

3. The cleaning apparatus according to claim 2, wherein the sensors have a thin and elongated shape, and extend almost for the entire length of the multilayer element, and wherein the sensors include electric contacts connected to additional electric contacts, the additional electric contacts being connected to the electronic circuit board so as to read data from the sensors.

4. The cleaning apparatus according to claim 3, wherein said sensors are joined to the lower non-woven layer of the absorbing panel with an insulating base placed between the sensors and the lower non-woven layer, in such a way that said sensors detect a moisture level of the cleaning cloth only and not a moisture level of the central panel, since the sensors are insulated from the central panel.

5. The cleaning apparatus according to claim 3, wherein said quadrangular peripheral hollowed frame of the multilayer element is provided centrally and on a bottom part thereof with at least two insulating strips arranged in spaced relation to each other and transversally or longitudinally with respect to said frame, wherein each of said insulating strips is provided on a bottom part thereof with said sensors for detecting moisture.

6. The cleaning apparatus according to claim 1, wherein the central panel is formed from polyurethane open-cell foam.

7. The cleaning apparatus according to claim 1, wherein a waterproof element is coupled to a central area of the upper non-woven layer, and wherein the waterproof element is adapted to guide the water arriving from the second pipe to a perimeter of the central panel, such that the central panel absorbs the water throughout an entire surface of the central panel, rather than only in the central area.

8. The cleaning apparatus according to claim 1, wherein said heating means comprises:

a heating plate, which includes a flat quadrangular elongated supporting body, made of metal and provided with a perimetric edge turned upward, a heating electric resistance and a temperature detecting means coupled to the supporting body, and a central vertical through hole, provided in the supporting body, for the passage of the water arriving from the second pipe, wherein said heating electric resistance, connected to and commanded automatically by the electronic circuit board, is adapted to heat the supporting body, which in turn is in direct contact with the multilayer element, in such a way that the water that conveys into the multilayer element is heated by said supporting body by thermal conduction, and wherein, the temperature detecting means, which is connected to and commanded by the electronic circuit board, detects the temperature of the water conveyed into the multilayer element, and, according to a preset temperature value, causes activation or deactivation of the electrical resistance, thereby maintaining the water at a desired temperature.

9. The cleaning apparatus according to claim 8, wherein the heating electric resistance has an elongated shape with a circular cross-section, and is housed within a groove defined in a lower surface of the quadrangular supporting body of the heating means.

10. The cleaning apparatus according to claim 8, wherein the temperature detecting means comprises a NTC thermistor probe.

11. The cleaning apparatus according to claim 1, wherein said quadrangular peripheral hollowed frame of the absorbing multilayer element includes quick attachment fittings at an edge thereof, for removably joining the quadrangular peripheral hollowed frame to the heating means.

12. The cleaning apparatus according to claim 8, wherein said control and command means for the cleaning modality comprises:

at least a turn on/off means, at least a selecting means, and at least a signaling lighting means of any shape, wherein, by said selecting means there is set a preset moisture level, that is signaled by a color or a specified flashing of a fixed light of the lighting means or by a specified lighting means among a plurality of lighting means and, subsequently, by a same methodology of illumination of the lighting means or by an acoustic signaling means, there is shown that, as detected by the temperature detecting means, a temperature needed for obtaining the preset moisture level has been reached, or that the water in the tank is exhausted.

13. The cleaning apparatus according to claim 8, wherein said control and command means for the cleaning modality comprises:

at least a display, wherein, on the display, are shown at least data concerning a preset moisture level, and at least data of a temperature detected by the temperature detecting means in ° C. or ° F., one or more means of starting and stopping the apparatus, one or more means for selecting the preset moisture level, wherein the display is provided with one or more lighting means of any shape, coupled with an acoustic signaling means, and adapted to show with a flashing or fixed light or particular color that the water in the tank is exhausted and/or that the temperature, as detected by the temperature detecting means, for obtaining the preset moisture level, has been reached.

14. The cleaning apparatus according to claim 12, further comprising a movement sensor connected to the electronic circuit board, that detects when the cleaning apparatus is moving and is therefore in use, wherein the electronic circuit board turns off the acoustic signaling means when the cleaning apparatus is moving and the acoustic signaling means is signaling that the desired temperature has been reached.

* * * * *